US005836286A

United States Patent [19]

Timmer et al.

[11] Patent Number: 5,836,286

[45] Date of Patent: Nov. 17, 1998

[54] ADJUSTABLE ECCENTRIC FUEL COUPLING

[75] Inventors: Robert C. Timmer, Grandville; Robert D. Straub, Lowell, both of Mich.

[73] Assignee: Diesel Technology Company, Wyoming, Mich.

[21] Appl. No.: 840,653

[22] Filed: Apr. 24, 1997

[51] Int. Cl.[6] ..... F02M 61/14

[52] U.S. Cl. ..... 123/470; 285/24; 285/122.1; 285/148.27; 285/321

[58] Field of Search ..... 285/24, 27, 122.1, 285/148.27, 160, 321; 60/740; 123/470

[56] References Cited

U.S. PATENT DOCUMENTS 1,304,980 5/1919 Hirshstein ..... 285/148.27
3,442,538 5/1969 Glasscock et al. ..... 285/148.27
4,747,384 5/1988 Hafner ..... 123/470
4,848,671 7/1989 Saurwein .
5,339,863 8/1994 Wie ..... 285/148.27 X

*Primary Examiner*—Dave W. Arola
*Attorney, Agent, or Firm*—Brooks & Kushman P.C.

[57] ABSTRACT

An eccentric member for coupling a fuel injector to an internal combustion engine cylinder head. The apparatus includes eccentric members that are rotatable to align fuel coupling components to compensate for gross accumulated component dimension tolerances, thereby allowing the use of economical and reliable O-rings to compensate for remaining tolerances. Embodiments of the apparatus include an eccentric, a coupling member and adapters having off-center fuel passages.

10 Claims, 3 Drawing Sheets

ADJUSTABLE ECCENTRIC FUEL COUPLING

TECHNICAL FIELD

This invention relates to adjustable fuel coupling devices using an eccentric member to couple fuel unit injectors to cylinder heads of internal combustion engines.

BACKGROUND OF THE INVENTION

Some fuel injectors used with internal combustion engines are supplied with fuel through a fuel passage, or bore, in a cylinder head. The portion of such a fuel injector that extends through the cylinder head, into a cylinder, is usually disposed about a fixed axis. The portion of the fuel injector that mates with a cylinder head fuel passage must be configured to accommodate an accumulation of dimension tolerances of associated mounting members and fuel passage openings.

This has been accomplished in the past by using a right circular cylindrical member extending from the fuel injector into a cylinder head recess of sufficiently oversized diameter to accommodate a maximum anticipated tolerance accumulation. A seal is maintained by O-rings annularly disposed between an outer surface of the cylindrical member and an inner surface of the recess. Naturally, with such a system, the inherent vulnerability to seal integrity failure increases proportionately with the amount of tolerance accumulation being accommodated.

U.S. Pat. No. 2,846,013, to Davis, discloses an alignment fitting designed to connect a well tubing head to another device offset therefrom. The alignment fitting includes a sleeve the opposing orifices of which are mutually offset. Rotating the sleeve rotates the axis of one orifice around that of the other. The alignment fitting has an angled passage the configuration of which is reflected by the structure of an intermediate inclined portion of its elongated sleeve.

This design, while perfectly adequate for its intended purpose of coupling two members substantially spaced apart, prevents the application of the alignment fitting to couple two closely disposed members. The entire length of the alignment fitting is disposed between the two members being coupled thereby. The alignment fitting of Davis also includes, at each of its ends, a flange to connect it to the respective members being coupled. The flanges rigidly connect the alignment fitting to the members being coupled and increase even more the distance required between them.

While the devices described in the foregoing function with a certain degree of efficiency, none disclose the advantages of the apparatus of the present invention as is hereinafter more fully described.

DISCLOSURE OF THE INVENTION

An object of the present invention is to provide an improved adjustable eccentric fuel coupling that compensates for dimension tolerance accumulation, or stack-up, between various elements of a fuel unit injector and a cylinder head.

Another object of the present invention is to provide an adjustable eccentric fuel coupling that allows the fuel unit injector and the cylinder head to be closely disposed.

A feature of the present invention is the use of an adjustable eccentric fuel coupling to compensate for tolerance accumulation in a wide variety of situations.

An advantage of the present invention is that it allows a design using traditional O-rings, which have established a record of reliability.

Another advantage of the present invention is its potential for relatively low-cost fabrication and maintenance.

In realizing the aforementioned and other objects, features and advantages, an adjustable eccentric fuel coupling device is provided for use with an internal combustion engine that includes a cylinder head having defined therein a cylinder head recess intersected by a fuel supply passage. The adjustable eccentric fuel coupling device includes an eccentric having contiguous first and second right circularly cylindrical portions respectively disposed at first and second ends of the eccentric. Each portion of the eccentric has a respective central axis, the central axes being parallel but laterally spaced apart.

The first right circularly cylindrical portion of the eccentric is insertable into a recess in a fuel unit injector, and the second right circularly cylindrical portion thereof is insertable into the cylinder head recess. The eccentric is rotatable to obtain an alignment of the first right circularly cylindrical portion and the recess in the fuel unit injector and to obtain an alignment of the second right circularly cylindrical portion and the cylinder head recess. In doing this, it compensates for a substantial amount of component dimension tolerance accumulation, or stack-up.

A fuel passage extends between a pair of orifices centrally disposed at each end of the eccentric. The passage provides an unobstructed fuel course between the recess in the cylinder head and the recess in the fuel unit injector.

A similar adjustable eccentric fuel coupling device further includes a coupling member, which has a first end and a second end. The coupling member also has a first right circularly cylindrical portion proximate its first end for threaded insertion into the recess in the fuel unit injector. The first right circularly cylindrical portion of the coupling member and the recess in the fuel unit injector define therebetween a coupling fuel chamber.

The coupling member also has a recess opening to its second end to rotatably receive at least a portion of the first right circularly cylindrical portion of the eccentric. The coupling member has defined therein a fuel passage for communicating fuel between the recess in the coupling member and the coupling fuel chamber.

Another embodiment of the adjustable eccentric fuel coupling device is provided for coupling an internal combustion engine having a cylinder head to a fuel unit injector. The cylinder head has a cylinder head recess that is intersected by a fuel supply passage. The fuel unit injector has a right circular coupling cylinder extending therefrom and having a fuel passage passing therethrough.

The adjustable eccentric fuel coupling device includes an adapter rotatably and sealingly disposed within the cylinder head recess. The adapter defines a right circular cylinder having an off-center circular aperture extending therethrough. The aperture sealingly receives the right circular coupling cylinder. The adapter is relatively free to slide along the right circular coupling cylinder between the fuel unit injector and the closed end of the recess in the cylinder head.

The adapter is rotatable to obtain an alignment of the right circular coupling cylinder and the recess in the cylinder head, thereby compensating for a substantial amount of dimension tolerance accumulation. A snap ring is also positioned in an annular recess in the right circular coupling cylinder to provide, if desired, a limitation of the sliding motion of the adapter therealong.

A similar adjustable eccentric fuel coupling device is also provided for coupling an internal combustion engine having a cylinder head to a fuel unit injector. The cylinder head has a cylinder head recess that is intersected by a fuel supply passage. The fuel unit injector has a fuel unit injector recess.

The adjustable eccentric fuel coupling device also includes a coupling member. The coupling member has a first end and a second end. It has a first right circularly cylindrical portion proximate its first end for threaded insertion into the recess in the fuel unit injector and has a second right circularly cylindrical portion proximate its second end.

An adapter is rotatably and sealingly inserted within the cylinder head recess. The adapter defines a right circular cylinder having an off-center circular aperture extending therethrough to sealingly receive the second right circularly cylindrical portion.

The adapter is rotatable to obtain an alignment of the second right circularly cylindrical portion of the coupling member and the recess in the cylinder head, thereby compensating for a substantial amount of dimension tolerance accumulation. A snap ring is also positioned in an annular recess in the right circular cylinder to provide, if desired, a limitation of the sliding motion of the adapter therealong.

The objects, features and advantages of the present invention are readily apparent from the following detailed description of the best mode for carrying out the invention when taken in connection with the accompanying drawing figures.

BRIEF DESCRIPTION OF THE DRAWING

A more complete appreciation of the invention and many of the attendant advantages thereof may be obtained by reference to the following detailed description when considered with the accompanying drawing in which like reference characters indicate corresponding parts in all the views, wherein.

BEST MODE FOR CARRYING OUT THE INVENTION

Figure 1:
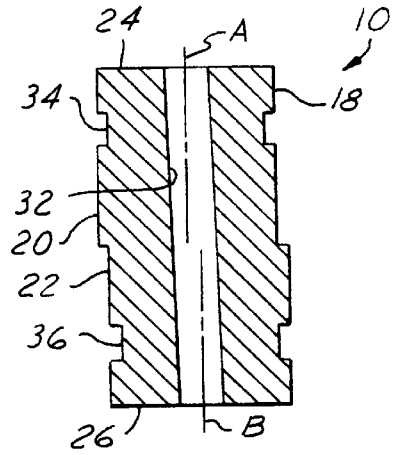
FIG. 1 is a sectional view of an eccentric of the present invention.

FIG. 1 of the drawing illustrates a first preferred embodiment of the adjustable eccentric fuel coupling device, generally indicated by reference numeral 10, of the present invention. Shown is an eccentric 18 having first and second ends, 24 and 26 respectively. A first right circularly cylindrical portion 20 extends from the first end 24 to a point generally midway between it and the second end 26. A second right circularly cylindrical portion 22 extends from the first right circularly cylindrical portion 20 to the second end 26. Each portion of the eccentric 18 has a central axis, A and B respectively. The central axes, A and B, are mutually parallel but are laterally spaced apart.

A fuel passage 32 extends between a pair of orifices centrally disposed at each end of the eccentric 18. The eccentric 18 also includes an annular recess, 34 and 36, defined in each of the first and second right circularly cylindrical portions, 20 and 22 respectively, thereof. A resilient sealing member, 38 and 40 (FIG. 2), is respectively disposed in each of the annular recesses, 34 and 36. The resilient sealing members are preferably O-rings.

Figure 2:
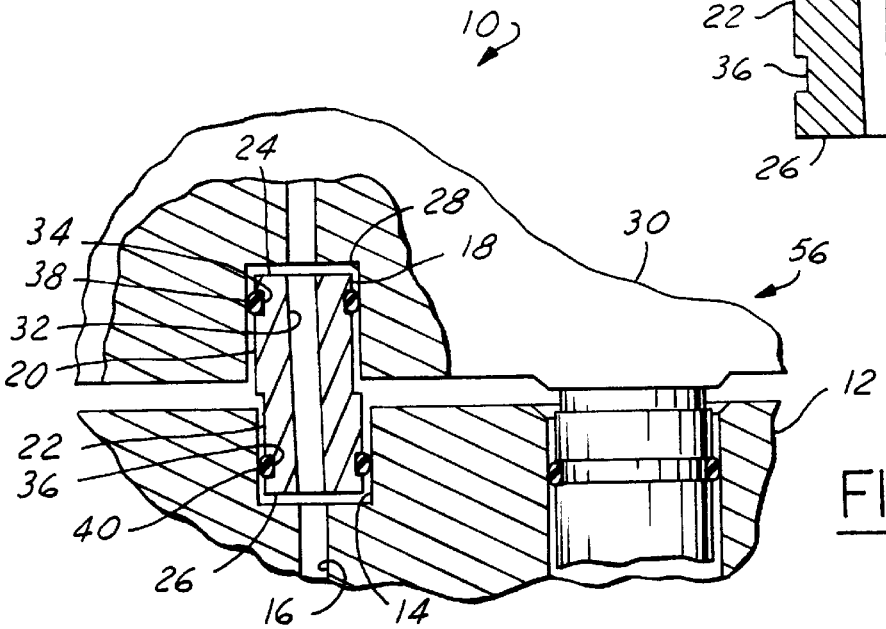
FIG. 2 is an environmental view, partially broken away and in section, of the eccentric of FIG. 1 as it appears in a typical application.

FIG. 2 of the drawing shows the eccentric 18 shown in FIG. 1 as it is used with a fuel injection apparatus, generally indicated by reference numeral 56. Shown cooperating with the eccentric 18 are a fuel unit injector 30 and a cylinder head 12 of an engine. The fuel unit injector 30 has a recess 28 that rotatably receives therein the first right circularly cylindrical portion 20 of the eccentric 18. The cylinder head 12 also has a recess 14 that rotatably receives therein the second right circularly cylindrical portion 22. The fuel passage 32 in the eccentric 18 provides an unobstructed fuel course between the recess 14 in the cylinder head 12 and the recess 28 in the fuel unit injector 30. The first and second ends, 24 and 26, of the eccentric 18 are not held in contact with the fuel unit injector 30 and the cylinder head 12 respectively. The eccentric 18 is relatively free to float therebetween.

Compensation for gross accumulated component dimension tolerances, or dimension stack-up, can be obtained by rotating the eccentric 18 to align the first right circularly cylindrical portion 20 of the eccentric 18 with the recess 28 of the fuel unit injector 30 and to align the second right circularly cylindrical portion 22 with the cylinder head recess 14. With the components aligned in the manner just described to compensate for gross accumulated component dimension tolerances, remaining tolerances can be economically and efficiently accommodated by the traditional O-rings. Hence, the first and second resilient sealing members, or O-rings, 38 and 40, prevent fuel from escaping from the recess 28 in the fuel unit injector 30, and from the recess 14 in the cylinder head 12, past the respective first and second right circularly cylindrical portions, 20 and 22, of the eccentric 18.

Figure 3:
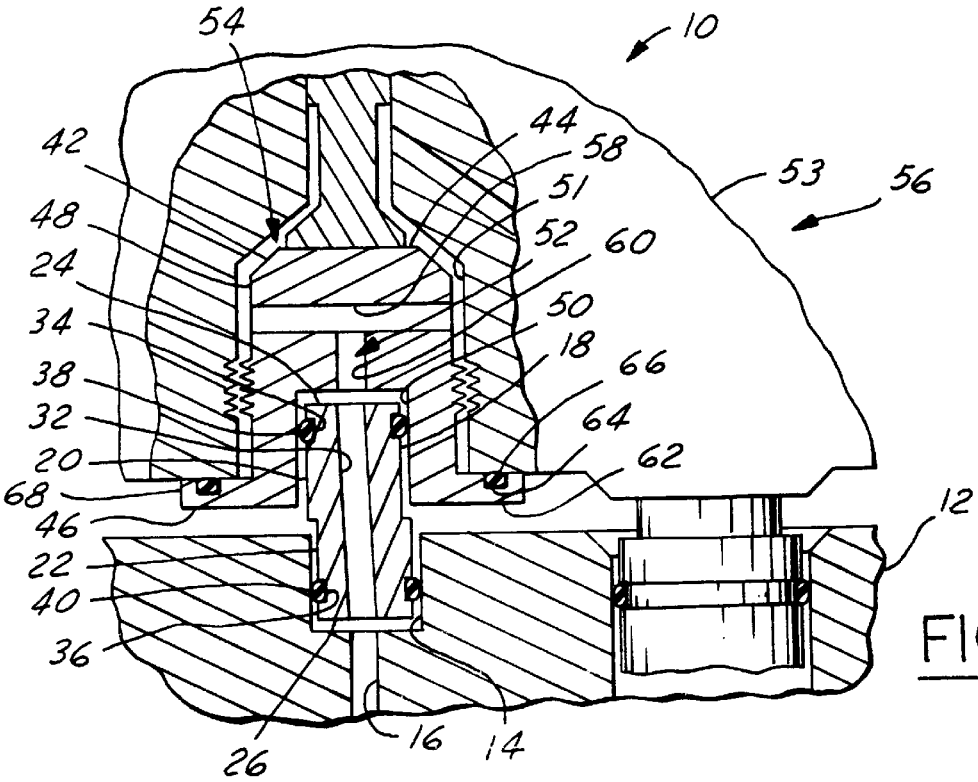
FIG. 3 is a view similar to that of FIG. 2 and including an additional member.

FIG. 3 of the drawing shows the eccentric 18 as used with a fuel injection apparatus similar to that shown by FIG. 2 and further including a coupling member 42. The coupling member 42 has a first end 44 and a second end 46. It has a right circularly cylindrical portion 48 and a laterally extending flange 62 proximate its second end 46. The right circularly cylindrical portion 48 is externally threaded for insertion into a recess 51 in the fuel unit injector 53, the recess 51 being internally threaded. The coupling member 42 has a recess 50 opening to its second end 46 to rotatably receive at least a portion of the first right circularly cylindrical portion 20 of the eccentric 18.

The first right circularly cylindrical portion 20 of the eccentric 18 is received by the recess 50 in a manner similar to that described for its reception by the recess 51 in the fuel unit injector 53. The first and second ends, 24 and 26, of the eccentric 18 are not held in contact with the coupling member 42 and the cylinder head 12 respectively, The eccentric 18 is relatively free to float therebetween.

The right circularly cylindrical portion 48 of the coupling member 42 and the recess 51 in the fuel unit injector 53 define therebetween a coupling fuel chamber, generally indicated by reference numeral 54. The coupling member 42 has defined therein a fuel passage, generally indicated by reference numeral 52, for communicating fuel between the recess 50 in the coupling member 42 and the coupling fuel chamber 54. The fuel passage 52 includes a lateral portion 58 extending between a pair of orifices open to the coupling fuel chamber 54 and diametrically oppositely disposed in the right circularly cylindrical portion 48 of the coupling member 42. It also includes a longitudinal portion 60 extending between the lateral portion 58 of the fuel passage 52 and the recess 50 in the coupling member 42.

The laterally extending flange 62 has an annular recess 64 disposed to receive a resilient sealing member, or O-ring, 66. The O-ring 66 seals the coupling member 42 to the fuel unit injector 53. The periphery of the flange 62 has a plurality of diametrically opposed flat portions 68 to facilitate the application of a wrench in threading the coupling member 42 into, or out of, the recess 51 in the fuel unit injector 53.

In a similar manner to that previously described in the discussion of FIG. 2, with the components aligned in the manner just described to compensate for gross accumulated component dimension tolerances, remaining tolerances can be economically and efficiently accommodated by the traditional O-rings. Hence, the first and second resilient sealing members, or O-rings, 38 and 40, prevent fuel from escaping from the recess 50 in the coupling member 42, and from the recess 14 in the cylinder head 12, past the respective first and second right circularly cylindrical portions, 20 and 22, of the eccentric 18.

Figure 4:
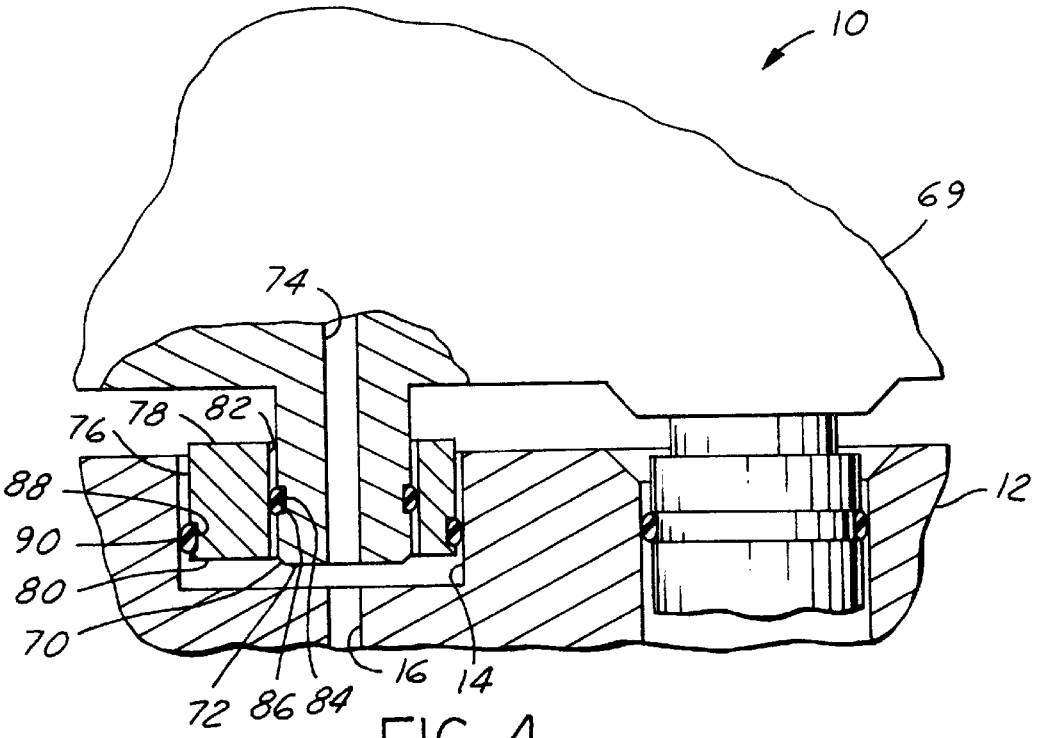
FIG. 4 is an environmental view, partially broken away and in section, showing a second embodiment of the present invention.

FIG. 4 of the drawing illustrates a second preferred embodiment of the adjustable eccentric fuel coupling device 10 of the present invention. Shown are a fuel unit injector 69 cooperating with a cylinder head 12. A right circular coupling cylinder 70, having a distal end 72, extends from the fuel unit injector 69. The coupling cylinder 70 has defined therein a fuel passage 74 to provide a fuel flow path from the recess 14 in the cylinder head 12.

The second preferred embodiment of the present invention further includes an adapter 76 having a first end 78 and a second end 80. It is formed as a right circular cylinder having an off-center circular aperture 82 extending therethrough. The adapter 76 is rotatably disposed within the recess 14 in the cylinder head 12, and the coupling cylinder 70 extends through its off-center circular aperture 82. The first and second ends, 78 and 80, of the adapter 76 are not held in contact with the fuel unit injector 69 or the cylinder head 12 respectively. The adapter 76 is relatively free to float therebetween.

The coupling cylinder 70 has an annular recess 84 defined therein to receive a resilient sealing member, or O-ring, 86. The O-ring 86 prevents the escape of fuel from the cylinder head recess 14 past the coupling cylinder 70. The adapter 76 has an annular recess 88 defined in the outer periphery thereof to receive a resilient sealing member, or O-ring, 90. The O-ring 90 prevents the escape of fuel from the cylinder head recess 14 past the adapter 76.

Compensation for gross accumulated component dimension tolerances can be obtained by rotating the adapter 76 to align the coupling cylinder 70 with the recess 14 in the cylinder head 12. With the components aligned in the manner just described to compensate for gross accumulated component dimension tolerances, remaining tolerances can be economically and efficiently accommodated by the traditional O-rings.

Figure 5:
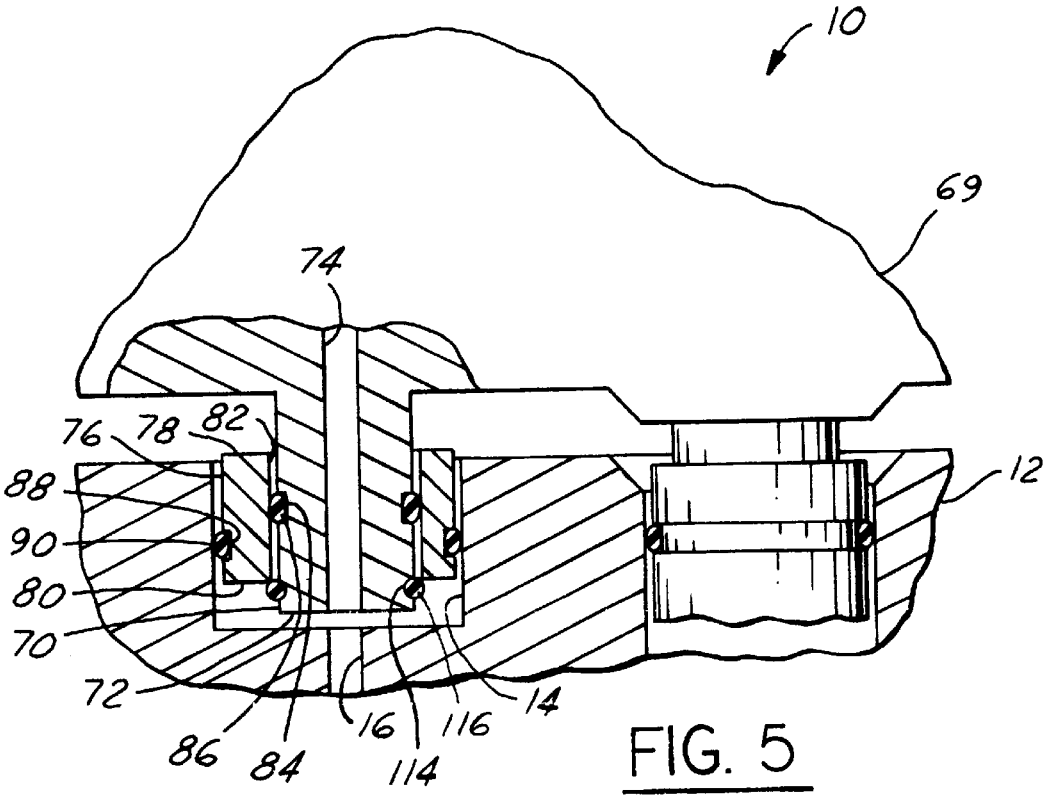
FIG. 5 is a view of a variation of the invention shown by FIG. 4.

FIG. 5 of the drawing illustrates a variation of the second embodiment of the adjustable eccentric fuel coupling device 10 of the present invention shown by FIG. 4. In addition to the annular recess 84 defined in the coupling cylinder 70, a second annular recess 114 is also defined therein to receive a snap ring 116. The snap ring 116 limits the travel of the adapter 76 toward the cylinder head 12. The adapter 76 is relatively free to float between the fuel unit injector 69 and the snap ring 116.

Figure 6:
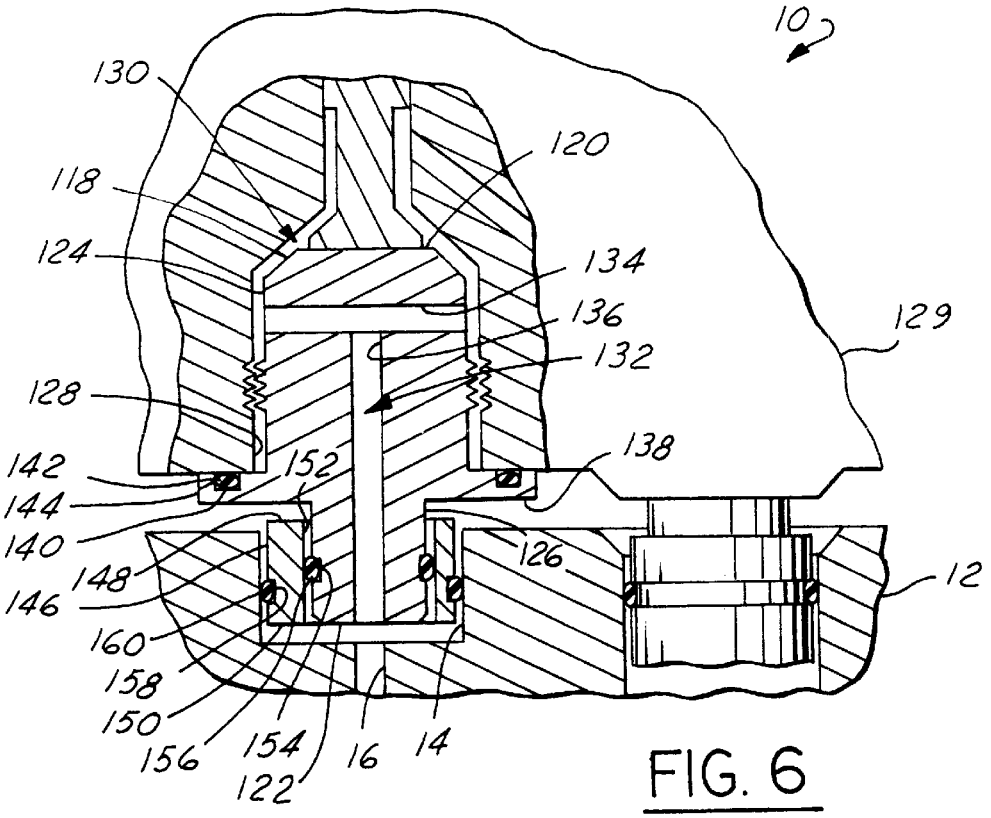
FIG. 6 is a view similar to that of FIG. 4 and including an additional member.

FIG. 6 of the drawing shows an adjustable eccentric fuel coupling device 10 of the present invention similar to that shown by FIG. 4. It includes a fuel unit injector 129 cooperating with a cylinder head 12 and further includes a coupling member 118. The coupling member 118 has a first end 120 and a second end 122. It has a first right circularly cylindrical portion 124 extending to its first end 120 and also has a second right circularly cylindrical portion 126 extending to its second end 122. The first right circularly cylindrical portion 124 is externally threaded for insertion into a recess 128 in the fuel unit injector 129, the recess 128 being internally threaded.

The first right circularly cylindrical portion 124 of the coupling member 118 and the recess 128 in the fuel unit injector 129 define therebetween a coupling fuel chamber, generally indicated by reference numeral 130. The coupling member 118 has defined therein a fuel passage, generally indicated by reference numeral 132, for communicating fuel between the recess 14 in the cylinder head 12 and the coupling fuel chamber 130. The fuel passage 132 includes a lateral portion 134 extending between a pair of orifices open to the coupling fuel chamber 130 and diametrically oppositely disposed in the first right circularly cylindrical portion 124 of the coupling member 118. It also includes a longitudinal portion 136 extending between the lateral portion 134 of the fuel passage 132 and the second end 122 of the coupling member 118.

A laterally extending flange 138 is disposed between the first and second right circularly cylindrical portions, 124 and 126. The laterally extending flange 138 has an annular recess 140 disposed therein to receive a resilient sealing member, or O-ring, 142. The O-ring 142 seals the coupling member 118 to the fuel unit injector 129. The periphery of the flange 138 has a plurality of diametrically opposed flat portions 144 to facilitate the application of a wrench in threading the coupling member 118 into, or out of, the recess 128 of the fuel unit injector 129.

The adjustable eccentric fuel coupling device 10 of the present invention further includes an adapter 146 having a first end 148 and a second end 150. It is formed as a right circular cylinder having an off-center circular aperture 152 extending therethrough. The adapter 146 is rotatably disposed within the recess 14 in the cylinder head 12, and the second right circularly cylindrical portion 126 extends through its off-center circular aperture 152. The first and second ends, 148 and 150, of the adapter 146 are not held in contact with the coupling member 118 or the cylinder head 12 respectively. The adapter 146 is relatively free to float therebetween.

The second right circularly cylindrical portion 126 of the coupling member 118 has an annular recess 154 defined therein to receive a resilient sealing member, or O-ring, 156. The O-ring 156 prevents the escape of fuel from the cylinder head recess 14 past the second right circularly cylindrical portion 126. The adapter 146 has an annular recess 158 defined in the outer periphery thereof to receive a resilient sealing member, or O-ring, 160. The O-ring 160 prevents the escape of fuel from the cylinder head recess 14 past the adapter 146.

Compensation for gross accumulated component dimension tolerances can be obtained by rotating the adapter 146 to align the second right circularly cylindrical portion 126 of the coupling member 118 with the recess 14 in the cylinder head 12. With the components aligned in the manner just described to compensate for gross accumulated component dimension tolerances, remaining tolerances can be economically and efficiently accommodated by the traditional O-rings.

Figure 7:
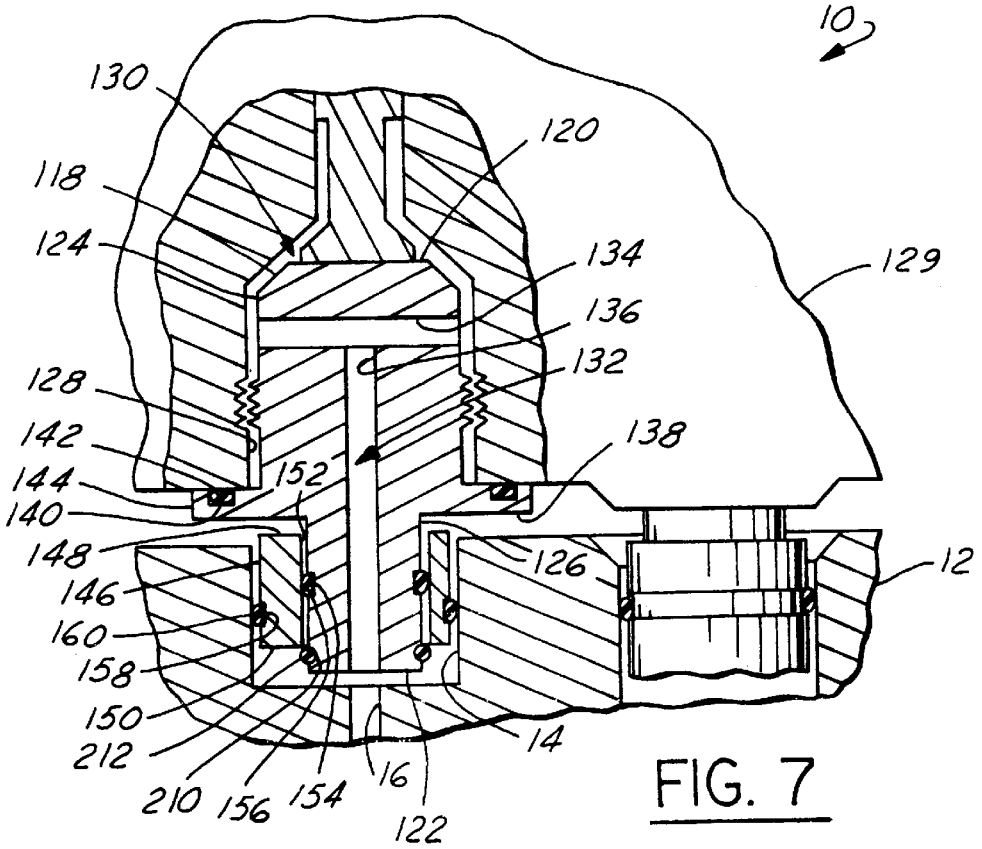
FIG. 7 is a view of a variation of the invention shown by FIG. 6.

FIG. 7 of the drawing illustrates a variation of the second embodiment of the adjustable eccentric fuel coupling device 10 of the present invention as shown by FIG. 6. In addition to the annular recess 154 defined in the second circular cylindrical portion 126 of the coupling member 118, a second annular recess 210 is also defined therein to receive a snap ring 212. The snap ring 212 limits the travel of the adapter 146 toward the cylinder head 12. The adapter 146 is relatively free to float between the fuel unit injector 129 and the snap ring 212.

While the best mode for carrying out the invention has been described in detail, those familiar with the art to which this invention relates should recognize various alternative designs and embodiments for practicing the invention as defined by the following claims.

What is claimed is:

1. An adjustable eccentric fuel coupling device for use with an internal combustion engine including a cylinder head (12) having defined therein a cylinder head recess (14) intersected by a fuel supply passage (16), the coupling device comprising:

an eccentric (18) having first and second ends (24, 26) and having contiguous first and second right circularly cylindrical portions (20, 22) respectively disposed proximate the first and second ends (24, 26), each portion having a central axis (A, B), the central axes being parallel but laterally spaced apart, the first right circularly cylindrical portion of the eccentric being sealingly insertable into a recess (28) of a fuel unit injector (30), the second right circularly cylindrical portion of the eccentric being sealingly insertable into the recess in the cylinder head, the eccentric being relatively free to float longitudinally within the recess of the fuel unit injector and the recess in the cylinder head, the eccentric also being rotatable to obtain an alignment of the first right circularly cylindrical portion with the recess in the fuel unit injector and of the second right circularly cylindrical portion with the recess in the cylinder head, thereby compensating for a substantial amount of dimension tolerance accumulation, and the eccentric also having defined therein a fuel passage (32) extending between a pair of orifices centrally disposed at each end of the eccentric to provide an unobstructed fuel course between the recess in the cylinder head and the recess in the fuel unit injector.

2. The device of claim 1, further including:

a coupling member (42), having a first end (44) and a second end (46), having a first right circularly cylindrical portion (48) proximate its first end for insertion into a recess (51) in a fuel unit injector (53), the first right circularly cylindrical portion of the coupling member and the recess in the fuel unit injector defining therebetween a coupling fuel chamber (54), the coupling member also having a recess (50) opening to its second end to rotatably and sealingly receive at least a portion of the first right circularly cylindrical portion of the eccentric, the eccentric being relatively free to float longitudinally within the recess of the coupling member and the recess in the cylinder head, the coupling member having defined therein a fuel passage (52) for communicating fuel between the recess in the coupling member and the recess in the fuel unit injector.

3. The device of claim 2, wherein the first right circularly cylindrical portion of the coupling member is at least partially externally threaded and the recess in the fuel unit injector is at least partially internally threaded to receive the threaded portion of the first right circularly cylindrical portion, thereby connecting the coupling member to the fuel unit injector.

4. The device of claim 2, wherein the fuel passage of the coupling member includes a lateral portion (58) extending between a pair of orifices open to the coupling fuel chamber and diametrically oppositely disposed in the first right circularly cylindrical portion of the coupling member and further includes a longitudinal portion (52), (60) extending between the lateral portion of the fuel passage and the recess in the coupling member.

5. An adjustable eccentric fuel coupling device for coupling an internal combustion engine, including a cylinder head (12) having defined therein a cylinder head recess (14) having a closed end and being intersected by a fuel supply passage (16), to a fuel unit injector (69) having a right circular coupling cylinder (70) extending therefrom and having a fuel passage (74) passing therethrough, the coupling device comprising:

an adapter (76) rotatably and sealingly disposed within the cylinder head recess, the adapter defining a right circular cylinder having an off-center circular aperture (82) extending therethrough to sealingly receive the right circular coupling cylinder (70), the adapter being relatively free to slide along the right circular coupling cylinder between the fuel unit injector and the closed end of the recess in the cylinder head, the adapter also being rotatable to obtain an alignment of the right circular coupling cylinder and the recess in the cylinder head, thereby compensating for a substantial amount of dimension tolerance accumulation.

6. The device of claim 5, further including a snap ring (116), the right circular coupling cylinder (70) having defined therein an annular recess (114) to receive and maintain the position of the snap ring, the snap ring allowing the adapter (76) to slide along the right circular coupling cylinder only between the fuel unit injector (69) and the snap ring.

7. An adjustable eccentric fuel coupling device for coupling an internal combustion engine including a cylinder head (12) having defined therein a cylinder head recess (14), which has a closed end and is intersected by a fuel supply passage (16), to a fuel unit injector (129) having defined therein a fuel unit injector recess (128), and including a coupling member (118) having a first end (120) and a second end (122), having a first right circularly cylindrical portion (124) proximate its first end for insertion into the recess in the fuel unit injector and having a second right circularly cylindrical portion (124) proximate its second end, the coupling device comprising:

an adapter (146) rotatably and sealingly disposed within the cylinder head recess, the adapter defining a right circular cylinder having an off-center circular aperture (152) extending therethrough to sealingly receive the second right circularly cylindrical portion, the adapter being rotatable to obtain an alignment of the second right circularly cylindrical portion of the coupling member and the recess in the cylinder head, thereby compensating for a substantial amount of dimension tolerance accumulation.

8. The device of claim 7, further including a snap ring (212), the second end (122) of the coupling member (118) having defined therein an annular recess (210) to receive and maintain the position of the snap ring, the snap ring allowing the adapter to slide along the right circular coupling cylinder only between the fuel unit injector and the snap ring.

9. The device of claim 7, wherein the first right circularly cylindrical portion of the coupling member is at least partially externally threaded and the recess in the fuel unit injector is at least partially internally threaded to receive the threaded portion of the first right circularly cylindrical portion, thereby connecting the coupling member to the fuel unit injector.

10. The device of claim 7, wherein the first right circularly cylindrical portion of the coupling member and the recess in the fuel unit injector defines therebetween a coupling fuel chamber, and wherein the fuel passage of the coupling member includes a lateral portion extending between a pair of orifices open to the coupling fuel chamber and diametrically oppositely disposed in the first right circularly cylindrical portion of the coupling member and further includes a longitudinal portion extending between the lateral portion of the fuel passage and the recess in the coupling member.

* * * * *